United States Patent [19]

Smith

[11] 3,972,295

[45] Aug. 3, 1976

[54] NEEDLE BAR PATTERN SHIFTING DEVICE

[75] Inventor: Randel P. Smith, Chattanooga, Tenn.

[73] Assignee: The Singer Company, New York, N.Y.

[22] Filed: Oct. 8, 1975

[21] Appl. No.: 620,518

[52] U.S. Cl. ..... 112/79 A

[51] Int. Cl.[2] ..... D05C 15/30

[58] Field of Search ..... 112/79 R, 79 A, 79 FF, 112/78

[56] References Cited

UNITED STATES PATENTS

| | | | |
|---|---|---|---|
| 3,026,830 | 3/1962 | Bryant et al. | 112/79 R |
| 3,511,976 | 5/1970 | Neidenberg et al. | 112/79 A |
| 3,596,617 | 8/1971 | Watkins | 112/79 R |

*Primary Examiner*—H. Hampton Hunter
*Attorney, Agent, or Firm*—Edward L. Bell; Robert E. Smith; Alan Ruderman

[57] ABSTRACT

A patterning device for a tufting machine having a reciprocating needle bar slidably mounted for lateral movement. The patterning device has a pair of solenoid actuated pawls mounted on the tufting machine head above the needle bar, and a pair of ratchet members mounted on the needle bar for cooperating with a respective pawl. The solenoids are individually controlled by a programmable pattern controller driven in synchronization with the tufting machine so as to engage the pawls selectively with the respective ratchet to force the needle bar to shift laterally. One pawl and ratchet acts to shift the needle bar to the right, and the other to the left. A centering tooth intermediate the pawls cooperates with an alignment plate to ensure precise shifting, and a needle bar locking tooth on the needle bar cooperates with a centering dog on the bed of the tufting machine to ensure that the needle bar does not shift while it is within the work piece.

7 Claims, 4 Drawing Figures

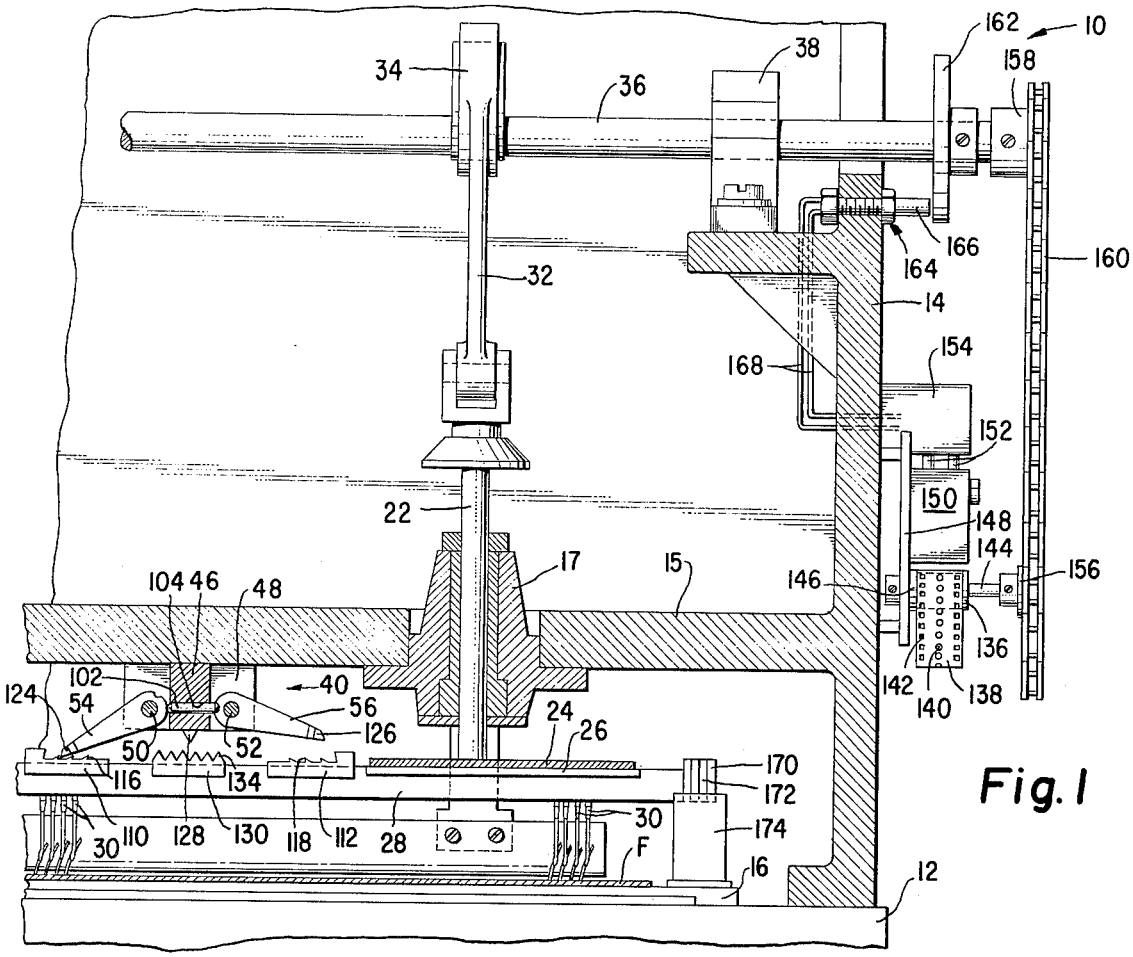
Fig. 1
Fig. 2
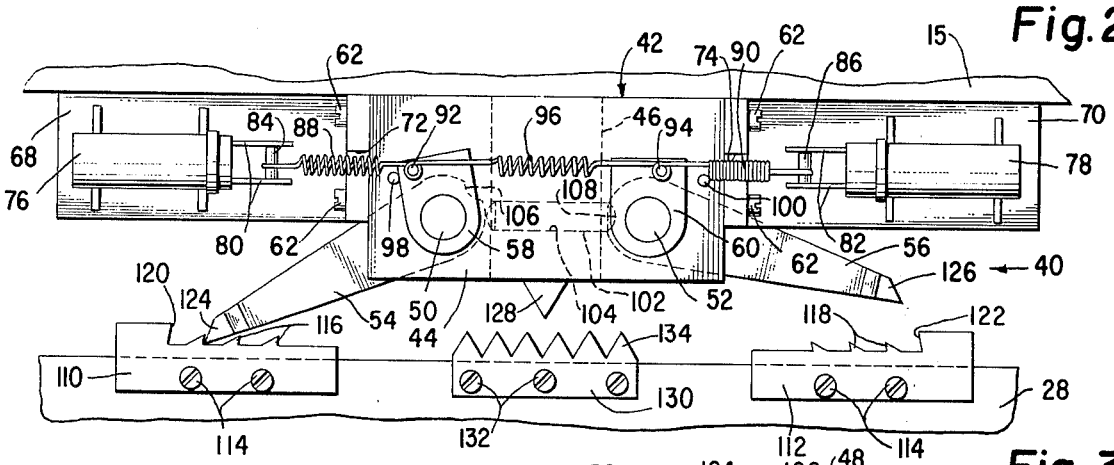
Fig. 4
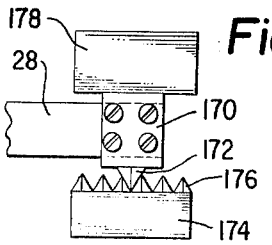
Fig. 3
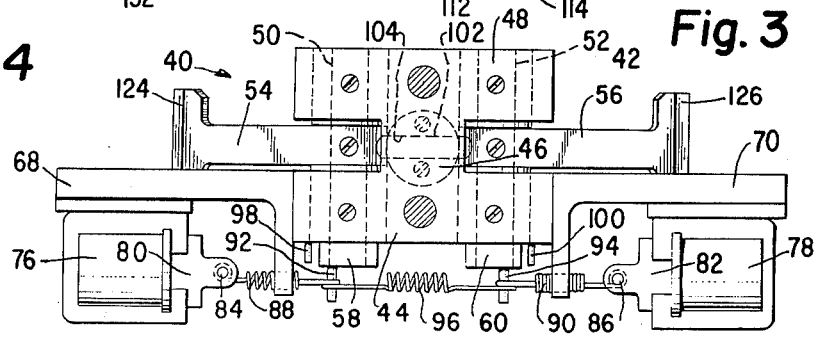

NEEDLE BAR PATTERN SHIFTING DEVICE

BACKGROUND OF THE INVENTION

This invention relates to tufting machines and more particularly to a new and improved patterning device for shifting the needles laterally across the tufting machine.

The art of tufting incorporates a plurality of yarn carrying spaced needles extending transversely across the machine and reciprocated cyclically to penetrate and insert pile into a backing fabric fed longitudinally beneath the needles. During each penetration of the backing fabric a row of pile is produced transversely across the backing. Successive penetrations result in a longitudinal row of pile produced by each needle. This basic method of tufting limits the aesthetic appearance of tufted carpet so produced.

Methods have been devised which effect relative shifting between the needles and the backing fabric which provide patterning capabilities and which break-up the noticeable alignment of the longitudinal rows that detract from the appearance of a carpet. Moreover, when using yarns of different color in different needles the shifting selectively transfers yarns of one color into a row normally having a different color. For example, U.S. Pat. of Bryant et.al. No. 3,026,830, Mar. 27, 1962 discloses a sliding needle bar mechanism so as to shift the needle bar laterally as it is reciprocated so that the needles on successive penetrations selectively cooperate with different individual loopers.

In this known shifting arrangement lateral movement of the needles relative to the backing fabric is controlled by a pattern cam similar to that illustrated in the aforesaid patent. Due to the physical limitations of cams the maximum amount of information that can be cut into a cam limits the available patterns produced. Thus, since there is a longitudinal pattern repeat every revolution of the pattern cam, the pattering capabilities of the prior art shifting devices are limited. The cams presently used to effect program shift are approximately one foot in diameter. To increase the pattern repeat interval would require that the cams be of greater diameter. However, the diameter and physical size of the cams are limited due to practical considerations. Moreover, the physical limitations of the cams and the difficulty in cutting intricate cams do not permit carpet designers the desired flexibility of pattern selection. Furthermore, another disadvantage of using pattern cams is that whenever a pattern is changed a different pattern cam must be installed. The time for changing cams together with the maintenance of the inventory of pre-cut pattern cams which must be on hand is an obvious disadvantage.

SUMMARY OF THE INVENTION

In order to overcome these deficiencies of the prior art shifters and to expand the patterning capabilities of tufting machines the present invention provides a novel patterning device which provides programmed transverse movement for a tufting machine provided with a slidable needle bar. The novel patterning device of this invention does not utilize pattern cams and therefore does not have the limitation of the prior art shifters. Wide variations of the shifting movements of needle bar, needle plate and backing fabric are made possible and therefore wide variation of pattern effects may be obtained. In the preferred embodiment a tape having a program in the form of holes punched in accordance with a pattern is provided to control the output of the shifter.

The patterning device of this invention comprises force transmitting means mounted on the head of the tufting machine and force receiving means mounted on the needle bar. The force transmitting means is selectively actuated in accordance with a pattern program to engage the force receiving means and shift the needle bar laterally as the needle bar approaches its top dead center position.

In the preferred form the force transmitting member comprises a pair of solenoid actuated pawl members and the force receiving member comprises a cooperating pair of ratchet members. A first pawl and ratchet effect a lateral shift in a first direction and the second pawl and ratchet effect a lateral shift in the second direction. The pawls are actuated upon selective energization of the respective solenoids controlled by the program. A centering tooth on the head and a cooperating centering guide plate on the needle bar are provided to ensure that the needle bar is correctly positioned as it reaches top dead center. This centering construction ensures that the needle bar is laterally aligned properly.

Another aspect of the invention is the provision of means for preventing undesirable lateral shifting of the needle bar. This is provided by a lock tooth on the needle bar which is received in a channel including a toothed dog mounted on the tufting machine bed after the needle bar has progressed passed top dead center and is moving downwardly.

Accordingly, it is a primary object of the present invention to provide a patterning device for effecting wide variations of lateral shifting of the needle bar of tufting machines provided with a laterally shiftable needle bar so as to provide wide variations of pattern effects in the tufted fabric.

Another object of this invention is to provide a tufting machine needle bar pattern shifting device controlled by a programmed source.

A further object of this invention is to provide a program controlled tufting machine needle bar pattern shifting device including means on the tufting machine for co-acting with a cooperating member on the needle bar for selectively shifting the needle bar laterally as the needle bar approaches top dead center and including centering means for precisely controlling the needle bar shift.

BRIEF DESCRIPTION OF THE DRAWINGS

Other objects and advantages of this invention will best be understood upon reading the following detailed description of the invention with the accompanying drawings, in which:

FIG. 1 is a fragmentary sectional view of a tufting machine incorporating a sliding needle bar patterning shifter constructed in accordance with the present invention;

FIG. 2 is an enlarged elevational view of the patterning shifter illustrated in FIG. 1;

FIG. 3 is a top plan view of the patterning shifter; and

FIG. 4 is an enlarged top plan view illustrating the needle bar position locking system of the present invention.

DETAILED DESCRIPTION OF THE PREFERRED EMBODIMENT

Referring now to the drawings there is illustrated a portion of a tufting machine 10 having a frame comprising a base 12 and a head 14 including a collar member disposed above the base. The base 12 includes a needle plate 16 over which a backing fabric F is adapted to be fed in a conventional manner.

Mounted in the head 14 for vertical reciprocation within the bushing assembly 17 is one of a plurality of push rods 22 to the lower end of which a needle bar support foot 24 is carried. The support foot 24 has a substantially inverted U-shaped configuration in end elevation including undercut flanges 26 at the extremities to form a guideway. A needle bar 28 substantially conforming in shape to the interior of the support feet so as to be slidably received therein is positioned within the guideway of the needle bar support feet. For a more detailed description of the construction of the needle bar reference is made to the aforesaid Bryant et.al. patent. The needle bar 28 may thus reciprocate with the push rods 22 and slide laterally relative thereto. The needle bar 28 in turn carries a plurality of needles 30 that are adapted to penetrate the fabric F on the needle plate 16 upon reciprocation of the needle bar 28 to project loops of yarn therethrough. Endwise reciprocation is imparted to the push rods 22 and thus the support foot 24 and the needle bar 28 and needles 30 by a link 32 which is pivotably connected at its lower end to the push rods 22 and at its upper end to an eccentric 34 on a driven rotary main shaft 36 that is journalled longitudinally in bearing blocks 38 mounted in the head. Although not illustrated a plurality of hooks adapted to cooperate individually with one of the needles to seize a loop of yarn presented by the needle and to hold the same as the needle is withdrawn is conventionally mounted for oscillating motion beneath the needle plate 16. Looper constructions of this type are illustrated, for example, in U.S. Pat. of Card, Nos. 2,976,829, Mar. 28, 1961 and 3,084, 645, Apr. 9, 1963.

In order to drive the needle bar 28 selectively with controlled lateral movement there is provided a new and improved patterning device according to the present invention and designated generally at 40. The patterning device 40 comprises a housing 42 having a substantially H-shaped configuration, when viewed in plan, including a front leg 44, a cross-piece 46 and a rear leg 48. The top of the housing 42 is secured by conventional means to the underside of the collar member 15 so as to be disposed above the top dead center position of the needle bar. Journalled in and extending between the front and rear legs 44 and 48 respectively on opposite sides of, and substantially parallel to, the cross-piece 46 are left and right stub shafts 50 and 52. Left and right pawls 54 and 56 are secured to the respective shafts 50 and 52 in the spaces intermediate the front and rear legs so as to swing within the space when the respective shaft is pivoted. Secured on the end of each shaft 50 and 52 externally of the front leg 44 is a respective lever 58 and 60. A turning movement applied to the lever members 58 and 60 will therefore effect a turning of respective pawl 54 and 56.

Attached as by screws 62 to the end of each front leg 44 of the housing 42 is a leg 64 and 66 of a respective L-shaped bracket 68 and 70. The legs 64 and 66 of the brackets 68 and 70 each have an upper portion extending forwardly beyond the front leg 44 of the housing 42 and includes a respective slot 72 and 74 undercut adjacent the extension. A respective solenoid member 76 and 78 is conventionally secured to the other legs of each bracket 68 and 70 and includes respective bifucated arms 80 and 82 secured to the solenoid armature so that energization of a solenoid effects a retraction of the corresponding arms 80 or 82. A respective pin 84 and 86 is attached between each pair of arms 80 and 82 for holding one end of a respective spring 88 and 90. The springs are positioned within the corresponding slots 72 and 74 and have their other ends fixed to a respective rod 92 and 94 secured to the front of the lever member 58 and 60 radially spaced from the shafts 50 and 52. Thus, energization of a solenoid effects a pivoting of the corresponding lever and its associated pawl 54 or 56.

A third or pawl retraction spring 96 may be positioned between the levers with its ends secured to the pins 92 and 94 so as to urge the lever and therefore the pawls 54 and 56 to turn in a direction opposite to the direction that the solenoids drive them. For example, the left solenoid 76 effects a turning of pawl 54 in a counter clockwise direction and the right solenoid 78 causes the pawl 56 to turn in the clockwise direction while the spring 96 urges the pawl 54 clockwise and the pawl 56 counter clockwise. The spring 96 should be weaker than springs 72 and 74 so as not to prevent rotation of the pawls by the solenoids. A stop member 98 and 100 fixed to the respective leg 64 and 66 limits the amount of travel of the pawls and properly positions the pawls. As hereinafter described the solenoids 76 and 78 are selectively individually energized to activate the appropriate pawl. In order to ensure that not more than one pawl is actuated a mechanical interlock is provided. This interlock comprises a pin 102 positioned within a hole 104 in the cross member 46 of housing 42. The pawls 54 and 56 have a substantially smooth arcuate preferably circular, circumference at the end that is secured to the shafts 50 and 52 and substantially radially disposed therefrom except for a small indentation 106 in the surface of pawl 54 and a smaller indentation 108 in the surface of pawl 56. The ends of the pin 102 are contoured and sized to complement the indentations 106 and 108 and the length of the pin is such that it extends from the identation of the pawl to a smooth circular surface of the other pawl. Thus, if one pawl is actuated the pin will prevent the other pawl from pivoting.

Disposed on the upper surface of the needle bar 28 are a pair of spaced ratchet plates 110 and 112. The plates may have a channeled lower surface adapted to set on the needle bar and secured thereto by screws 114 for cooperating with the respective pawls 54 and 56. For reasons which will hereinafter become clear the ratchet plates 110 and 112 each respectively have a plurality of teeth 116 and 118 having a force receiving substantially vertical surface, which, if preferred, may be cantered slightly to the pivotal axis of the respective pawl, and a slip surface sloping upwardly toward a common vertical, i.e., toward the end opposite to which the ratchet is located. Each ratchet plate 110 and 112 is illustrated as having three hardened teeth 116 and 118 respectively so that together with the substantially vertical surface of its respective end 120 and 122 there are four lateral steps or shifts available. However, this number is arbitrary and can be varied to give more shifts if required by a specific pattern. The force receiving surface on the teeth and end of each ratchet plate are preferably spaced apart by the machine gauge space, i.e., the spacing between adjacent lateral needles or loopers of the tufting machine, or a multiple thereof. The pawls 54 and 56 respectively have a tooth 124 and 126 formed of a hardened steel for transmitting a force to the teeth 116 and 118 respectively upon selective energization of the solenoids.

Secured on the underside of the cross leg 46 of the housing 42 is a centering or alignment tooth 128 which preferably has tapered side walls. A centering or alignment plate 130 is mounted on the needle bar 28 between the ratchet plates 110 and 112 and is secured thereto by the screws 132. The upper surface of the plate 130 comprises a plurality of teeth 134 sloping on both sides from a crest to a nadir with a valley between each two adjacent teeth. The number of teeth being such that there is at least one more valley than there are lateral shifts for reasons which will hereinafter become clear. The spacing between teeth 134 is accurately machined to the exact shifting increment desired, i.e., the gauge or spacing between the needles. The valleys between the teeth 134 are adopted to receive the tooth 128 when the needle bar is at top dead center. Therefore, the tooth 128 extends from the housing 42 and is vertically located at the top dead center position of the valleys between teeth 134, which of course move vertically with the needle bar.

In operation when the pattern calls for a lateral shift the appropriate solenoid is energized. This effects a pivoting of the associated pawl until it hits the associated stop member, and when the needle bar rises the pawl engages one of the teeth of the cooperating ratchet to force the needle bar to shift one space. The lateral movement of the pawl, which is determined by the arc of swing, is selected so as to be substantially one tooth space. Prefeerably the solenoid is energized just after the needle bar reaches top dead center and is descending. The preferred time is approximately five degrees after top dead center. The solenoid is thus seated before the needle bar reaches bottom dead center. As the needle bar rises the pawl engages the ratchet after the needles are free of the fabric. This occurs at approximately 60 degrees before top dead center when producing conventional pile height tufted fabric. Engagement will occur between two ratchet teeth and as the needle bar continues upwardly the pawl tooth engages the force receiving surface of the ratchet tooth. Once this occurs the pawl and ratchet are effectively coupled until the needle bar begins to descend. Continued upward movement of the needle bar forces the pawl to pivot upwardly and the reaction of the pawl and pawl mounting construction is a force against the ratchet. The needle bar is therefore given a lateral force component which forces it to shift laterally as it continues to top dead center. The amount of shift is controlled by the arc through which the pawl swings and the geometry of the party. The lateral component of the pawl's swing determines the lateral shift. Just prior to reaching top dead center the centering tooth 128 enters a valley between a pair of teeth of the centering plate 130, and as the needle bar reaches top dead center the tooth 128 seats in the nadir of the valley. If the needle bar 28 is not exactly aligned or centered relative to the tooth 128, the tooth 128 acts against an inclined walls of the teeth 134 to shift the needle bar until the tooth 128 is seated. Thus the needle bar shifting increment is accurately controlled.

In order to control the action of the solenoids and therefore the tufted pattern produced by the tufting machine, timed electrical signals are selectively transmitted to the solenoids in accordance with a programmed pattern. The preferred medium for storing the pattern in the form of a program is a punched tape. This type of medium provides the advantages of flexibility of pattern changing, minimum space for storage of the medium, and a simple and inexpensive process for entering the pattern information. One form of program controller for reading the program on the tape and generating the timed sequence of electrical signals to operate the solenoids is illustrated in FIG. 1. This program controller, which is fully described in U.S. Pat. of Neidenburg et.al. 3,511,976, May 12, 1970, includes a rotary cyclindrical drum 136 having an electrically conductive surface overwhich the punched tape 138 is trained. The tape includes a plurality of sprocket holes 140 in which sprocket teeth form circumferentially on the drum are adapted to extend to drive the tape. The program is punched in the tape in the form of holes 142. The drum 136 is mounted on a shaft 144 journalled in a housing 146 secured to a panel 148. The panel is attached to the head 14 of the tufting machine. Mounted above the drum 136 is a housing 150 within which is supported a brush contact frame (not shown) supporting a plurality of electrical contact brushes (also not shown) which ride on the surface of the tape and make contact with the drum through the holes 142 in the tape. The brush frame may be swung selectively away from the drum to permit withdrawal or insertion of the tape on the drum. Preferably there is one brush per channel of information on the tape. Each brush is connected to conductors extending through conduits 152 connecting into a circuit located within an electrical circuit and junction box 154. A common brush contact (not shown) is mounted so as to always contact the conductive surface of the drum and whenever one of the other brushes engages the drum through a punched hole 142 in the tape the circuit for that channel is closed. When no hole is present the circuit is open. Circuit closure is programmed on a line basis along the longitudinal axis of the tape. The tape may be endless, as illustrated, or may be one wound from one reel onto another. For a more complete disclosure of the program controller reference may be had to the aforesaid U.S. Pat. No. 3,511,976.

To drive the tape in timed relationship with the needle bar the present invention provides a sprocket 156 on the free end of the shaft 144. A second sprocket 158 may be fixed to the respective end of the main shaft 36 and a chain 160 is trained about the sprockets to rotate the shaft 144 to thereby drive the shaft 136 in timed relationship with the tufting machine. Moreover, in order to sychronize the signals from the tape program with the tufting machine so that the solenoids may be energized at the proper instant of the cycle, i.e., preferably at 5° above top dead center a metallic timing disk 162 is fixed on the main shaft 36 adjacent the free end and includes a slotted radial opening (not shown) approximately 15 degrees in arc. A proximity probe 164 is threadedly mounted in the wall of the head 14 and includes a sensing head 166 extending toward and just spaced from the surface of the disk 162. The probe which is basically a metal detector, includes conducting leads 168 which extend into circuit box 154 and connect to a proximity switch (not shown) in the circuit with the brushes of the program controller. Whenever the solid circumference of the disk is adjacent the probe head 166 the primary output of the sensor goes high and when the slot passes the head 166 the primary output is switched low. A timed pulse is thereby provided to conventional logic circuitry upon receiving the low signals from the proximity head primary output and together with a signal from the tape circuit will energize the appropriate solenoid. For a full disclosure of such circuitry reference is had to my co-pending application (Docket No. 01CB/50901) filed on even date herewith.

As an additional safeguard for correct positioning of the needle bar so as to ensure that it has shifted by an interval of a gauge space or a multiple thereof, and to lock the needle bar against undesirable lateral movement at needle penetration and especially at loop seizure when the needles are engaged by the loopers, a needle bar position locking device is provided. This device comprises a block 170 having a centering tooth 172 mounted on at least one end of the needle bar. A centering dog 174 having a plurality of teeth 176 is provided on the bed or the needle plate 16 of the tufting machine for receiving the tooth 172. There are at least one more teeth 176 as there are number of shifts of the needle bars so that there is at least one more valley between the teeth then there are shifts. A block 178 is spaced from the dog 174 by an amount so as to sandwich the block 170 within an effective channel when the tooth 172 is positioned between two teeth 176. As the needle starts down it floats free for the initial portion of its travel, which preferably is approximately the initial quarter of its travel. At that time the tooth 172 engages between the teeth 176 of the dog 174 and the rear surface of block 170 engages block 178 so that the needle bar is firmly guided in the channel at the proper lateral position during the remainder of its downward stroke. It continues to be guided by the tooth 172, dog 174 and block 178 after its reaches bottom dead center and begins its upward travel and is released therefrom at the instant or slightly after the pawl, if actuated, engages the ratchet.

Numerous alterations of the structure herein disclose will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus described the nature of the invention, what we claim herein is:

1. A patterning device for a tufting machine having a reciprocating needle bar carrying a plurality of needles disposed laterally across the machine and adapted to penetrate a backing moving longitudinally of the machine to insert a plurality of stitches upon each penetration of the backing, and means for mounting said needle bar for lateral movement relative to said backing, said pattering device comprising: a pair of normally inactive oppositely directed lateral force transmitting members mounted on the tufting machine above said needle bar, a pair of lateral force receiving members mounted on said needle bar and individually disposed to cooperate with a respective one of said force transmitting members as the needle bar moves upwardly and approaches the top dead center position, and pattern control means for activating one of said force transmitting members selectively into coupling engagement with the cooperating force receiveing member to shift said needle bar laterally.

2. A patterning device as recited in claim 1 wherein said force transmitting members each comprise a pawl, means for pivotably mounting each pawl for controlled movement toward and away from said needle bar, said pattern control means effecting movement of said pawl toward the needle bar, said force receiving members each comprising a ratchet member secured to the needle bar and having a plurality of spaced teeth disposed so as to have a force receiving surface and a slip surface, each force receiving surface being disposed for engaging a respective activated pawl as the needle bar moves upwardly toward top dead center.

3. A patterning device as recited in claim 2 wherein said pawls are mounted for pivotable movement in a vertical plane extending laterally relative to the tufting machine.

4. A patterning device as recited in claim 2 wherein said pattern control means comprises means for generating electrical signals, solenoid means energized selectively by said signals, and means for connecting said solenoids to said pawls for moving said pawls selectively.

5. A patterning device as recited in claim 1 including centering means for controlling the increment of shift of the needle bar, said centering means comprising a centering tooth mounted on said tufting machine above said needle bar, and an alignment plate having a plurality of laterally spaced teeth secured to said needle bar, the spacing between said teeth being substantially equal to one increment of shift, said centering tooth being wedged between adjacent teeth when the needle bar is at top dead center.

6. A patterning device as recited in claim 1 including locking means for securing the needle bar against lateral movement during penetration of the backing by the needles, said locking means comprising a member including a longitudinally disposed tooth positioned on said needle bar, means on the tufting machine defining a lateral channel for receiving said member and said tooth, said channel including a plurality of teeth laterally spaced apart by a distance substantially equal to one increment of shift, said longitudinally disposed tooth adapted to be wedged between adjacent teeth of the channel, said channel being of a length in the direction of reciprocation of said needle bar such that the tooth remains therein while the needles are within the backing.

7. A patterning device as recited in claim 3 including means for interlocking said pawls to prevent movement of one pawl when the other pawl is activated.

* * * * *